US005460443A

United States Patent [19]

Ferrari et al.

[11] Patent Number: 5,460,443

[45] Date of Patent: Oct. 24, 1995

[54] DEVICE FOR FASTENING AND ADJUSTING THE FRONT PANEL OF A DRAWER WITH RESPECT TO THE SIDE

[75] Inventors: Franco Ferrari, Frazione Deviscio, 2, 22053 Lecco; Carlo Migli, Lecco, both of Italy

[73] Assignee: Franco Ferrari, Lecco, Italy

[21] Appl. No.: 237,722

[22] Filed: May 3, 1994

[30] Foreign Application Priority Data

May 13, 1993 [IT] Italy ..... MI93U0397

[51] Int. Cl.[6] ..... A47B 95/00

[52] U.S. Cl. ..... 312/348.4

[58] Field of Search ..... 312/348.4, 330.1, 312/263

[56] References Cited

U.S. PATENT DOCUMENTS

| | | | |
|---|---|---|---|
| 5,222,791 | 6/1993 | Held et al. | 312/348.4 |
| 5,281,022 | 1/1994 | Röck | 312/348.4 |
| 5,364,181 | 11/1994 | Scheible | 312/348.4 |

FOREIGN PATENT DOCUMENTS

| | | | |
|---|---|---|---|
| 3801103 | 8/1988 | Germany | 312/348.4 |
| 3931155 | 3/1991 | Germany | 312/348.4 |
| 1185585 | 3/1970 | United Kingdom | 312/348.4 |

*Primary Examiner*—Kenneth J. Dorner
*Assistant Examiner*—Robert J. Sandy
*Attorney, Agent, or Firm*—Shlesinger Fitzsimmons Shlesinger

[57] ABSTRACT

A device (10) for fastening and adjusting the front panel (12) of a drawer with respect to the side panel (11) comprises a sliding element (26) which is made to slide by shifting means (19, 21) in the direction of the length of the side panel. The sliding element (26) comprises a hook-shaped end (28) which engages with complementary hooking means (32) fitted on the front panel, so as to support the front panel and draw the hooking means close to the device upon operation of the shifting means (19, 21), thereby blocking the movement of the front panel with respect to the side panels of the drawer. The sliding element (26) can be raised by means of an adjusting screw (30) to provide adjustment of the vertical position of the front panel. The shifting means and the adjusting screws are provided with respective control ends protruding from the lower side of the device and extending along a lower edge of the side panel containing the device.

9 Claims, 1 Drawing Sheet

DEVICE FOR FASTENING AND ADJUSTING THE FRONT PANEL OF A DRAWER WITH RESPECT TO THE SIDE

BACKGROUND OF THE INVENTION

This invention refers to an innovative device for fastening and adjusting the front panels of drawers. There are known drawers in which the front panel is fitted so as to be adjustable in position, in order to permit its precise alignment with the other front elements adjacent to it. In these drawers the adjusting system is usually housed on the lateral surface of the side panels close to the front panel and access to the screws which enable it to be operated is also lateral. This gives rise to aesthetical problems, since the mechanism and the screws are visible when the drawer is open, as well as functional problems, and makes it difficult for example to adjust the front panels whenever there are objects protruding from the side of the drawer.

In order to prevent the screws from showing when the drawer is open, cover plates are normally used purely for aesthetical purposes, which, however, more often than not are merely palliatives.

The general scope of this invention is to obviate the aforementioned problems, by providing a device for fitting and adjusting the front panel of a drawer which makes the front panel easier to fit, the adjustments simpler to carry out and the overall appearance more attractive.

SUMMARY OF THE INVENTION

This scope is achieved according to the invention by providing a device for fitting and adjusting the front panel of a drawer with respect to the side panel, characterized by the fact that the device comprises a sliding element controlled by shifting means, the device being intended to be fitted on the side panel of the drawer so as to have said sliding element disposed with its sliding direction parallel to the length of the side panel, the sliding element comprising a hook-shaped end which engages with complementary coupling means designed to be fitted on the front panel to support the front panel and bring the coupling means close to the device upon operation of the shifting means, the sliding element having a hook-shaped end which can be lifted by means of an adjusting screw to adjust the vertical position of the front panel, the shifting means and the adjusting screw having respective control ends which protrude from the lower side of the device and extend along a lower edge of the side panel.

BRIEF DESCRIPTION OF THE DRAWINGS

The innovatory principles of this invention and its advantages compared to the known technique will be more clearly evident from the following description of a possible exemplificative and non-restrictive embodiment applying such principles, with reference to the accompanying drawings, in which.

DETAILED DESCRIPTION OF THE INVENTION

Figure 1:
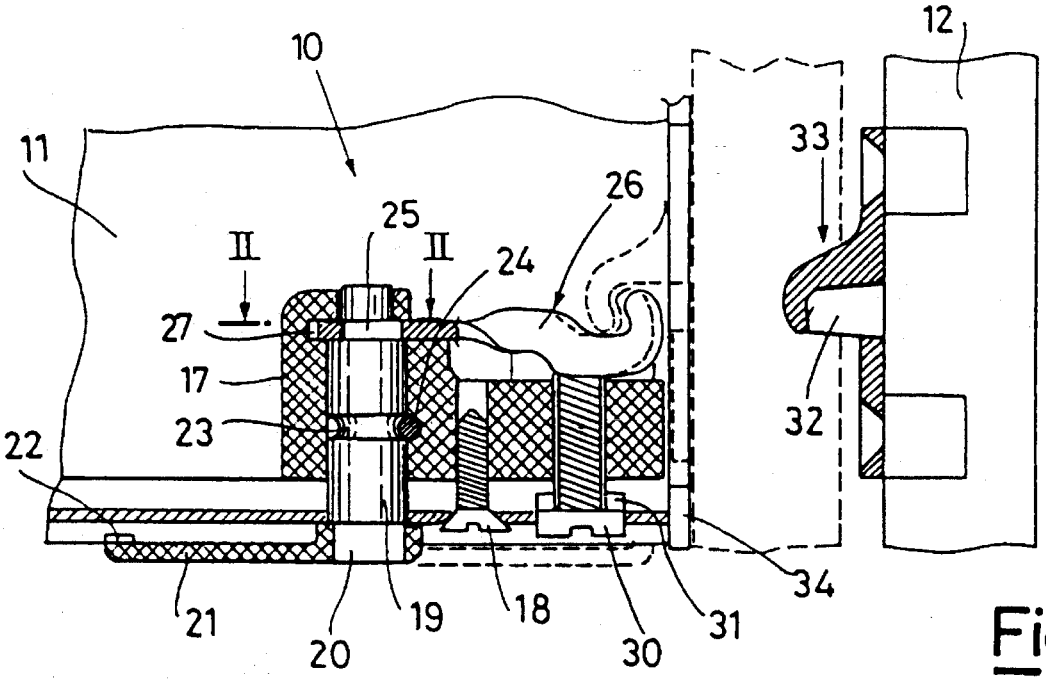
FIG. 1 shows a partial cutaway, side, scrap view of a drawer applying the innovative front panel securing and adjusting device claimed herein.

With reference to the figures, FIG. 1 shows a portion of a side panel 11 of a drawer onto which is fitted a front panel 12 by means of an innovative securing device indicated generically by reference 10. The side panel can comprise known sliding means for the drawer which are not shown.

Figure 2:
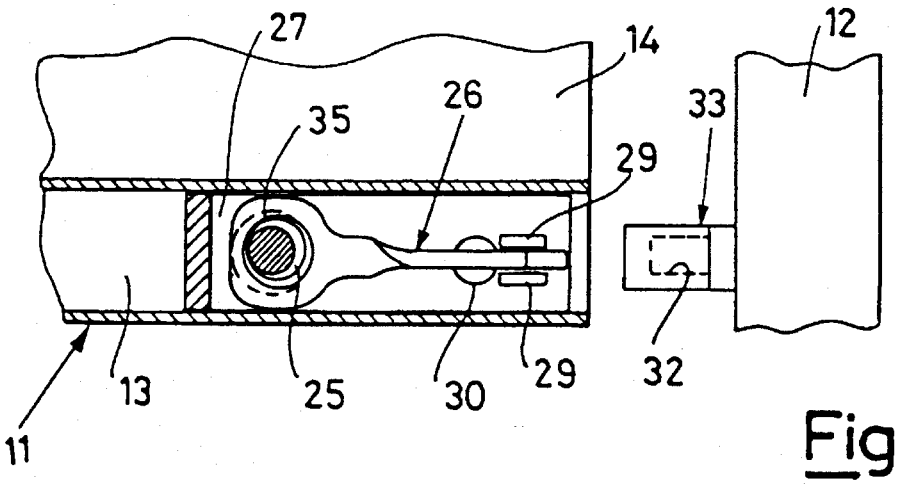
FIG. 2 shows a cross sectional view along the line II—II of FIG. 1.
Figure 3:
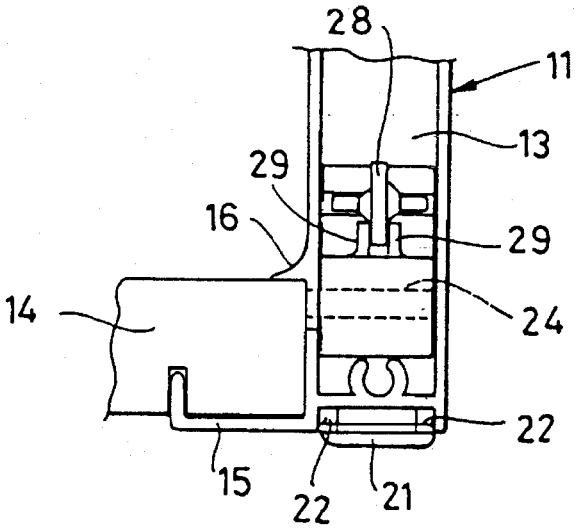
FIG. 3 shows a front view of the device of FIG. 1.

As can be clearly seen in FIGS. 2 and 3, the device 10 is housed inside a recess 13 made in the side panel which opens out at the end of the side panel on which the front panel rests. The side panel can advantageously be made in the form of a box-shaped section. The side panel also comprises known fastening means to secure it to the base 14 of the drawer. For example, they may consist of shaped wings 15, 16 which fit into the side edge of the base. The front panel fastening and adjusting device comprises a casing 17 fastened to the inside of the side panel by means of a screw 18 locked on the underside of the side panel.

The casing 17 is provided with a vertical hole or recess which rotatingly houses a pivot 19. The pivot 19 is provided with a lower control end 20, accessible from the underside of the side panel, to enable it to be rotated axially by at least 180°. For example, in order to rotate it easily without the need for implements, the control end can be provided with a control lever 21, disposed parallel to the lower edge of the side panel to enable it to be rotated from the position shown by the continuous line to the position shown by the broken line in FIG. 1. If required, two teeth 22 can be provided protruding from the end of the lever which interfere with raised edges on the side panel and hold the lever firmly in each of its two positions.

The pivot 19 comprises, in a position half way between the ends, a circumferential groove 23 in correspondence with which the casing 17 is provided with a horizontal hole which receives a pin 24 preventing the axial sliding of the pivot 19 while enabling its axial rotation. As can be clearly seen in FIG. 3, the pin can for example be inserted through a hole made in the internal lateral surface of the side panel which is subsequently covered by the side of the base 14.

As can be seen in FIGS. 1 and 2, close to the upper portion of the pivot 19 is a cylindrical section 25 off-centre with respect to the axis of rotation of the pivot.

In correspondence with the eccentric section 25, the casing 17 is provided with a horizontal slot or groove 27, open towards the front panel of the drawer, which receives the tail end of a coupling element 26, with a hole 35 in correspondence with the pivot to receive the eccentric section of the pivot with a minimum clearance in the direction of the length of the sliding element. The coupling element 26 can advantageously be cut from sheet metal, folded at 90° to form the horizontal tail end containing the hole 35 and a hook-shaped top end 28 disposed in a vertical plane. Upon rotation of the control pivot 19, the coupling element is shifted via the eccentric section 25, and slides horizontally in a direction parallel to the side panel 11 to move away from or towards the front panel. As can be clearly seen in FIG. 3, the coupling element 26 slides between protrusions or lateral guides 29 protruding from the casing 17 to prevent rotation of the element 26 around the eccentric section 25. Close to its hook-shaped front end the element 26 rests on the end of a screw 30 which is screwed vertically in a through hole in the casing 17 so that its head can be operated from the underside of the side panel. The tail portion of the element 26 has sufficient clearance in the groove 27 to permit the element 26 to slant upwards to a degree permitted by the stroke-end or fully tightened position of the screw 18. The head of the screw 30 is housed in a cavity 31 which enables the screw to be adjusted without its head protruding excessively from the lower part of the side panel 11.

As shown in FIG. 1, in correspondence with the coupling end 28, the front panel 12 is provided with a housing 32 for the coupling end. For example, said housing can be made by means of an element 33 pre-fitted on the front panel by means of dowels or screws and provided centrally with a hook shape recess in complementary to that of the end 28. As can be seen in FIG. 2, the crosswise width of the recess in housing 32 is greater than the thickness of the coupling tooth 28 so that there can be lateral sliding between the front panel and tooth 28 within the limits established by the difference between the width of the housing recess and the thickness of the tooth.

At this point it will be clear how the intended scope has been achieved. The two side panels of the drawer will house two coupling devices 10 and the front panel will have two matching housings 32. For example, the two devices can be assembled directly in the side panels, by fastening the casing 17 by means of the screw 18, fitting the hook 26 in the housing 27, inserting the pivot and then the lock pin 24. The lateral surfaces of the side panels are completely free and do not require any aesthetical component to conceal the adjusting devices. Once the devices 10 are fitted, the front panel can be coupled to it as shown by the broken line in FIG. 1. If required, in order-to prevent the front surface of the side panels from scratching the internal part of the front panel during adjustment, an intermediate gasket 34, for example made of plastic, can be pre-fitted on the front part of the side panels. The crosswise adjustment of the position of the front panel with respect to the drawer and, consequently, any other front elements of the furniture unit, can be achieved by means of the side clearance existing between the coupling element 26 and the recess in housing 32. The vertical adjustment, on the contrary, can be carried out by more or less completely tightening the screw 30 adjusting the height of the hook 28. Once the correct alignment of the front panel has been identified, the front panel can be locked in place by rotating the pin 19 by 180° so that the cam shifts or draws back the hook-shaped element, pulling it taut and pressing the front panel against the side panels. Rotating the lever 21 towards the forward position, which pulls the hook taut, in addition to locking the front panel in place, also renders the adjusting screws inaccessible and consequently protects them from becoming accidentally loosened.

The foregoing description of an embodiment applying the innovatory principles of this invention is obviously given merely by way of example in order to illustrate such innovatory principles and should not therefore be understood as a limitation to the sphere of the invention claimed herein.

For example, the coupling housing 32 for the pull hook 28 can be made in the thickness of the front panel, making the hook 28 long enough to protrude frontally from the side panels. In this case the housing can for example be formed from a recess in the front panel partially covered by a striking plate for the hook. Likewise, in the case of front panels made of metal box section, it is sufficient to provide an inlet passage for the hook.

Moreover, the head of the adjusting screw 30 can be advantageously shaped in such a way as to render the use of tools, such as a screwdriver, superfluous for its adjustment. For example, the head can be shaped in such a way as to be grasped with the fingers, or provided with a crosswise slot of such size as to be turned with a coin. Conversely, the pivot 19 can also be made without the control lever and provided with a control head which can be engaged by means of a screwdriver or the like.

What is claimed is:

1. Device for adjustably securing the front panel of a drawer to the forward edge of a side panel of the drawer, characterized by the fact that the device comprises a casing disposed to fit in an opening in said side panel of the drawer a sliding element having a hook-shaped end, means for mounting said element on said casing so as to have horizontal sliding movement, including means operable to shift said element in opposite directions to move said hook-shaped end thereof toward and away from said forward edge of the side panel, the hook-shaped end of said element being disposed to engage with complementary coupling means designed to be fitted on the front panel of the drawer to support the front panel on said forward edge upon operation of the shifting means, said hook-shaped end being adjustable by means of an adjusting screw on said casing to adjust the vertical position of the front panel on said side panel, and the shifting means and the adjusting screw having respective control ends which are disposed to face upon and to be accessable from the lower edge of the side panel.

2. The device as claimed in claim 1, characterized by the fact that the coupling means comprises a housing having therein a recess to receive the hook-shaped end of the sliding element, said recess in said housing being of a greater width crosswise than the width of the hook-shaped end to enable the horizontal adjustment of the position of the front panel with respect to the side panel.

3. The device as claimed in claim 1, characterized by the fact that the shifting means comprise an axially rotatable Vertical pivot having a lower end forming said control end thereof and having an eccentric section close to the upper end thereof which is housed in a housing in the sliding element, whereby upon axial rotation of the pivot the eccentric section effects shifting the sliding element in said opposite directions.

4. The device as claimed in claim 3, characterized by the fact that the pivot has the control end thereof integral with a radial rotating lever.

5. The device as claimed in claim 4, characterized by the fact that the lever is in a position which covers the control end of the adjusting screw when the sliding element is in the position in which it engages the coupling means.

6. The device as claimed in claim 3, characterized by the fact that the sliding element is made from shaped sheet metal, the hook-shaped end beings disposed in a vertical plane and the opposite end thereof being rotated at right angles to lie in a horizontal plane, said opposite end being perforated to form the housing for the eccentric section of the pivot.

7. The device as claimed in claim 6, characterized by the fact that said opposite end of the sliding element is housed with vertical clearance in a substantially horizontal groove in the device which is traversed by the pivot, in order to allow the adjusting screw to lift the hook-shaped end by slanting the sliding element.

8. The device as claimed in claim 1, characterized by the fact that the coupling means comprise an element designed to be protrudingly secured to the front panel and centrally provided with a hood shaped recess complementary to that of the hook-shaped end of the sliding element.

9. The device as claimed in claim 3, characterized by the fact that the pivot in a position half way has therein intermediate which is seated a preventing a pin the axial sliding of the pivot while enabling its free axial rotation.

* * * * *